US007967224B2

(12) United States Patent
Belau et al.

(10) Patent No.: US 7,967,224 B2
(45) Date of Patent: Jun. 28, 2011

(54) SPRAY HEAD FOR ATOMIZING A MEDIUM

(75) Inventors: Rüdiger Belau, Bad Oldesloe (DE); Lutz Maske, Elmenhorst-Fischbek (DE); Campbell Patrick, Bad Oldesloe (DE)

(73) Assignee: Boehringer Ingelheim microParts GmbH, Dortmund (DE)

( * ) Notice: Subject to any disclaimer, the term of this patent is extended or adjusted under 35 U.S.C. 154(b) by 0 days.

(21) Appl. No.: 11/568,747

(22) PCT Filed: Mar. 14, 2005

(86) PCT No.: PCT/EP2005/002676

§ 371 (c)(1),
(2), (4) Date: Aug. 1, 2007

(87) PCT Pub. No.: WO2005/108240

PCT Pub. Date: Nov. 17, 2005

(65) Prior Publication Data

US 2008/0164345 A1 Jul. 10, 2008

(30) Foreign Application Priority Data

May 5, 2004 (DE) ..... 10 2004 022 131

(51) Int. Cl.

| | |
|---|---|
| ***B05B 1/00*** | (2006.01) |
| ***F23D 11/38*** | (2006.01) |
| ***A62C 13/62*** | (2006.01) |
| ***B65D 83/00*** | (2006.01) |
| ***B65D 83/14*** | (2006.01) |

(52) U.S. Cl. ..... 239/600; 239/589; 239/302; 239/337; 222/635; 222/402.13

(58) Field of Classification Search ..... 239/589, 239/526; 222/402.13

See application file for complete search history.

(56) References Cited

U.S. PATENT DOCUMENTS 2,592,808 A * 4/1952 Knapp ..... 251/321

(Continued)

FOREIGN PATENT DOCUMENTS

DE 9103135.4 U1 6/1991

(Continued)

*Primary Examiner* — Dinh Q Nguyen
*Assistant Examiner* — Justin Jonaitis
(74) *Attorney, Agent, or Firm* — Roberts Mlotkowski Safran & Cole, P.C.; David S. Safran

(57) ABSTRACT

The invention relates to a spray head for atomising a medium using a pressurised propellant, with a spray head body (10) which comprises a fastening ring (6) and an actuating element (20) movably connected thereto, a holding element (12) which comprises an inlet port (24), an adjoining duct section (26) and a holding section (28), and a duct element (14) which has an outlet port (62) for the medium and which has in at least one section a diameter such that the medium to be discharged atomizes in the flow of propellant, the duct element (14) preferably being a capillary pipe or capillary tube and/or having a constant diameter over its entire length, the duct element (14) being arranged in the holding section (28) of the holding element (12) and, preferably, being bent through approximately 90° in the holding section (28) of the holding element (12) and the holding element (12) preferably being connected to the spray head body (10). The assembly of this spray head is made easier by the fact that the holding element (12) comprises, at least in the holding section (28), particularly at the upper end thereof, at least one clamping element (50) for clamping or latching the duct element (14) on the holding element (12).

17 Claims, 3 Drawing Sheets

U.S. PATENT DOCUMENTS

Figure 1:
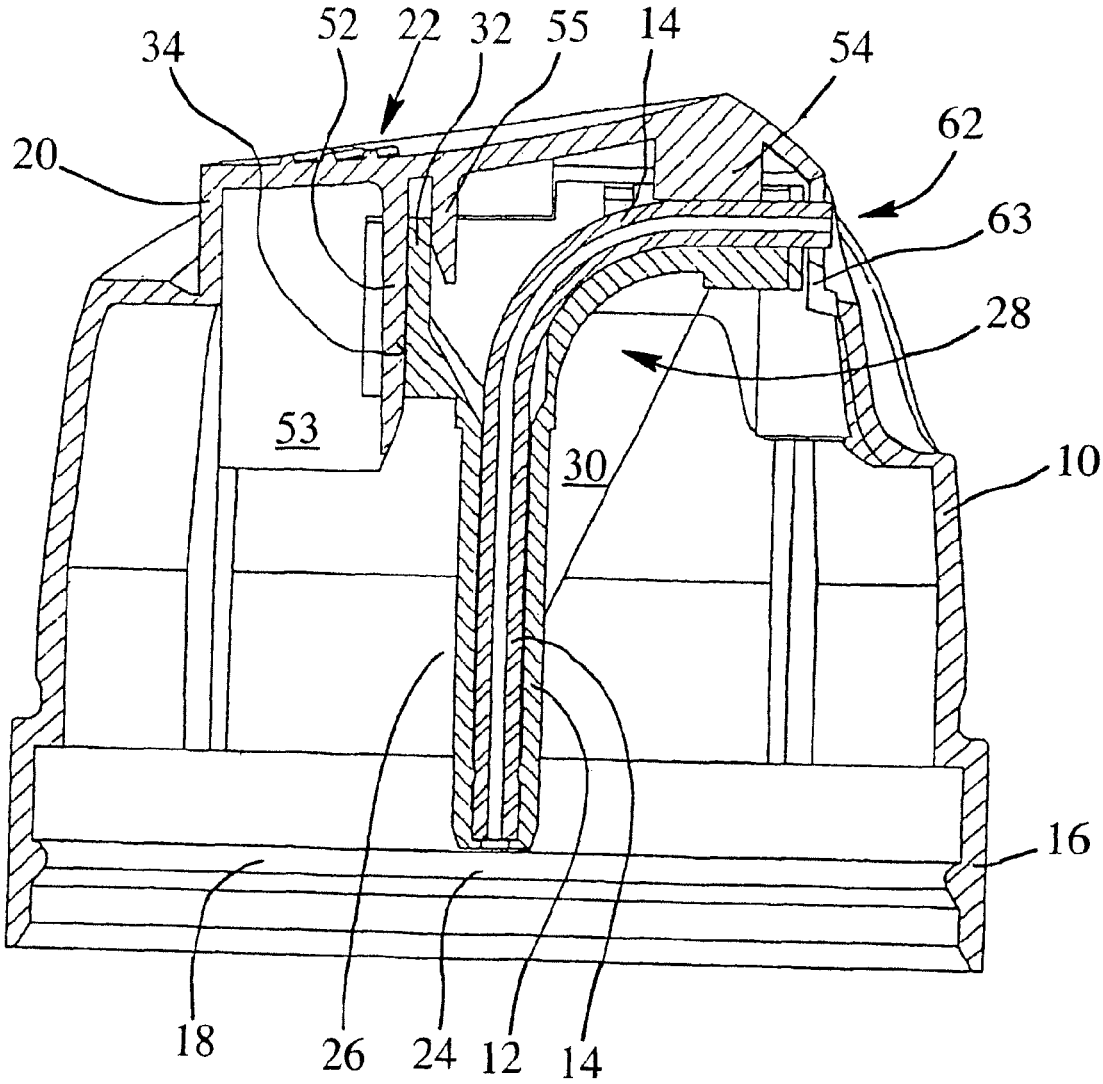

| | | | | | |
|---|---|---|---|---|---|
| 3,189,232 | A | | 6/1965 | Joffe | |
| 3,233,783 | A | * | 2/1966 | Thornton | 222/83 |
| 3,515,316 | A | * | 6/1970 | Green | 222/207 |
| 3,698,604 | A | * | 10/1972 | Nigro | 222/182 |
| 4,775,922 | A | * | 10/1988 | Engel | 362/217.07 |
| 5,018,647 | A | * | 5/1991 | Abplanalf | 222/108 |
| 5,711,484 | A | * | 1/1998 | Blette et al. | 239/104 |
| 6,708,852 | B2 | * | 3/2004 | Blake | 222/321.5 |
| 7,121,434 | B1 | * | 10/2006 | Caruso | 222/402.13 |

FOREIGN PATENT DOCUMENTS

| | | | |
|---|---|---|---|
| WO | 03 051522 | A2 | 6/2003 |
| WO | 2004 041326 | A2 | 5/2004 |

* cited by examiner

SPRAY HEAD FOR ATOMIZING A MEDIUM

The invention relates to a spray head for atomising a medium having the features of the preamble of claim 1. A spray head of this kind is fitted onto a spray can or bottle and actuated by simple pressure on an operating mechanism so that the medium is delivered as a spray mist.

Conventional aerosol spray systems operate with large volumes of propellant gas as the medium is sprayed through complicated valve and nozzle structures.

A valve is known from WO 03/051522 A1 wherein the medium is atomized or sprayed through a capillary tube without a nozzle. The known valve is designed for flow rates of 0.5 g/s to 0.01 g/s. WO 03/051522 A1 describes how the dimensions of the capillary tube of the valve are to be selected in order to allow spraying of the atomized medium. The result of using the capillary tube is that at atmospheric pressure a volume ratio of only 1:50 to 1:5000 is needed for the ratio of medium to propellant gas. At the same time, little propellant gas is required and the spray containers can be designed with a small capacity.

In principle, nozzle-free atomising of liquid media using a capillary tube has been known for decades (U.S. Pat. No. 2,592,808 A). With a spray head as described herein for atomising a medium using a pressurized propellant, a spray head body has a holding device which comprises an inlet port, an adjacent sealed tubular duct section and adjacent thereto a holding section which is bent at 90°. The holding device also includes an actuating element for the spray head body which forms the component complementary to the holding section. A tubular duct element in the form of a capillary tube or capillary pipe which has a constant diameter over its entire length is passed in an arc shape between the holding section and the complementary part of the actuating element and its end projects laterally over the holding section. The tubular duct element constructed as a capillary tube has no nozzle and leads to nebulisation of the medium by transporting it in the capillary tube and expelling it therefrom.

The actuating element and the holding section are pressed upwardly against a stop by means of a tension spring. This holds the actuating element and the holding section against one another. This alone fixes the tubular duct element in the holding section. This has some disadvantages from the assembly point of view as in practice the assembly has to be done under the pressure of a tension spring. These difficulties in the assembly process have the major disadvantage that a tubular duct element constructed as a capillary tube is very easily irreparably damaged. The rejection rate during assembly of a spray head of this kind would therefore be high.

The teaching is based on the problem of improving the known spray head as described above from the point of view of the assembly process.

The problem stated above is solved in a spray head having the features of the preamble of claim 1 by means of the features of the characterizing clause of claim 1. Preferred embodiments and further features are recited in the subsidiary claims.

The construction as described having at least one clamping element enables the tubular duct element, i.e. in particular the capillary tube, to be fixed in the holding section of the holding element beforehand, i.e. in a clamped or latched position, and thus allows the tubular duct element to be handled together with the holding element during the assembly process without it being damaged. It is also possible to fit the holding element first. Then the tubular duct element can simply be inserted in the tubular duct section of the holding section and then clamped or latched in the holding section. To this extent, therefore, prefixing is also carried out.

Particularly preferably, the teaching of the invention is implemented by the fact that the holding section has at least one pair of clamping jaws which surround the tubular duct element.

Preferably, the tubular duct element protrudes over the holding section at the upper end, just as it does in the starting position. However, it is also possible to close off the opening of the tubular duct element with the holding section. In any case it is advisable for the holding section to have at least one opening on the side remote from the bend.

The holding element preferably has a closed tubular duct section extending in the longitudinal direction of the spray head body, into which the tubular duct element is inserted. The holding element also preferably has a cylindrical receiving section for a seat of a valve. The tubular duct section expediently has one or more surrounding holding projections which clamp the tubular duct element in position without reducing its internal diameter.

In a preferred embodiment the holding element additionally has an attachment which comprises a back wall extending in the longitudinal direction of the spray head body, this back wall being arranged approximately in the region of the holding section. The back wall has, on the side remote from the outlet port, a recess which is laterally delimited by walls facing away from the outlet port.

The spray head body has a projection facing towards the holding element and abutting flat on the back wall of the attachment in the recess on the side walls. In addition, the spray head body has at least one second projection which abuts on the back wall on the side facing towards the outlet port. Moreover, the spray head body has at least one abutment surface abutting on the holding element. The force from the actuating element is transmitted through the holding element to the valve via the abutment surface.

In addition, the spray head body preferably comprises connecting means which secure the holding element therein. The connecting means comprise two projections facing one another, with projecting lugs which engage behind the holding element close to the outlet port of the tubular duct element. The connecting means are preferably in the form of snap-fit means, so that the holding element together with the tubular duct element inserted therein can snap into the spray head body.

Figure 2:
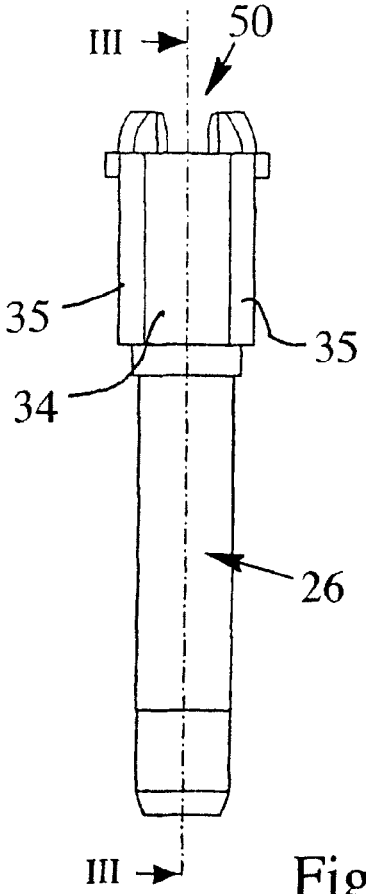
Figure 3:
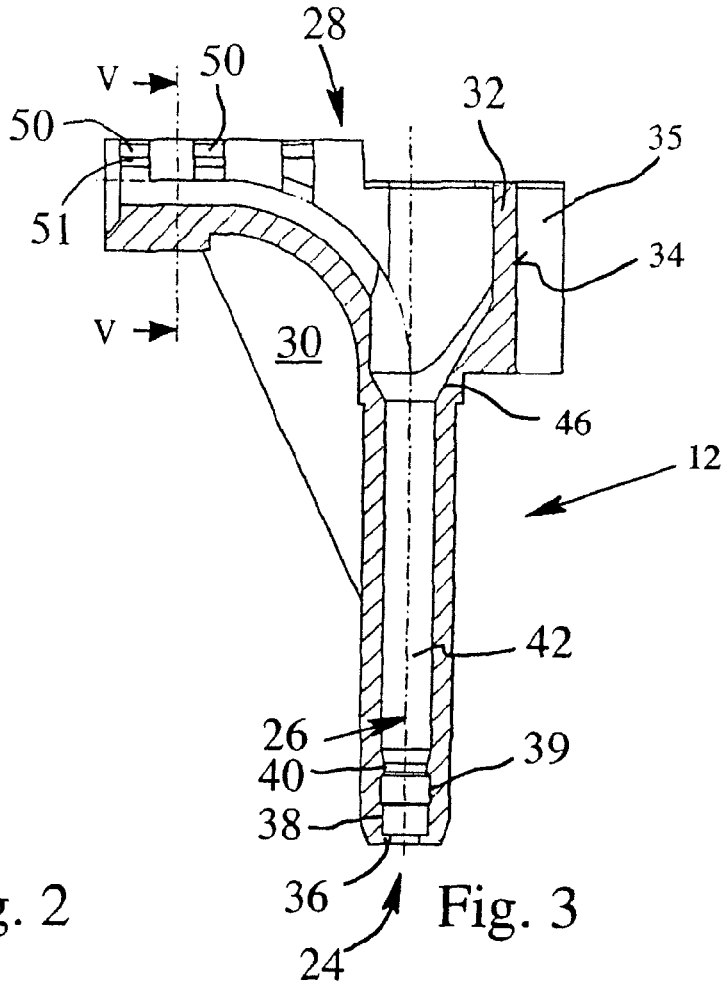
Figure 4A:
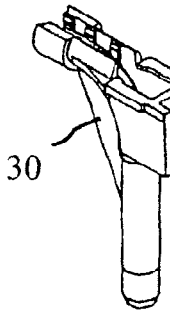
Figure 4B:
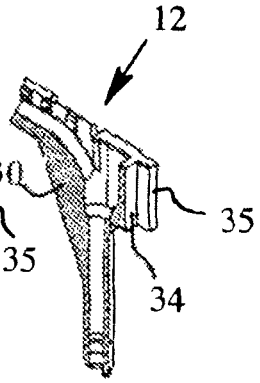
Figure 5:
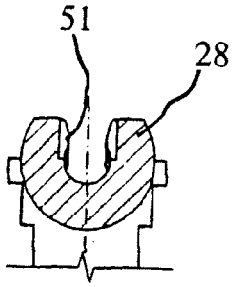
Figure 6:
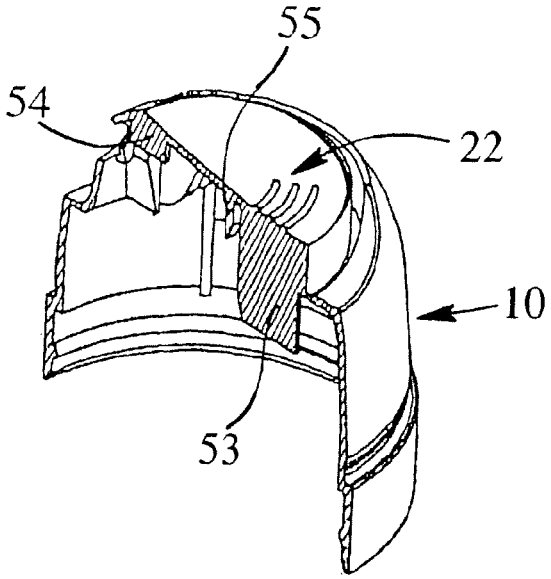
Figure 7:
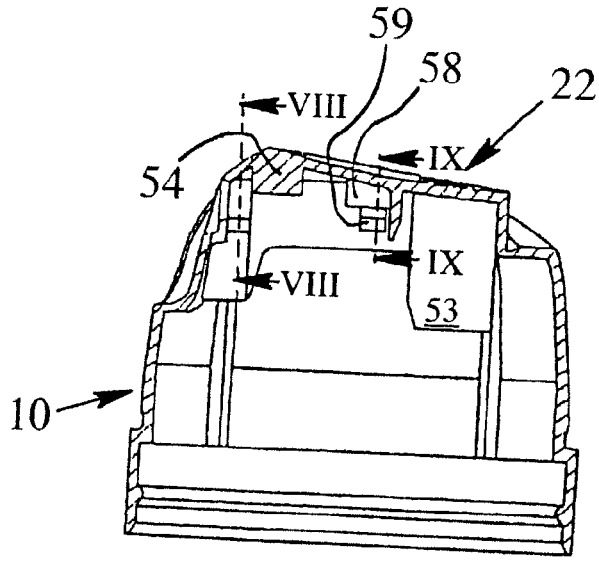
Figure 8:
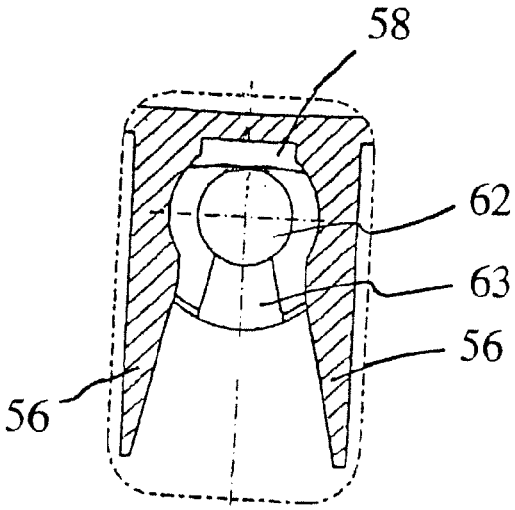
Figure 9:
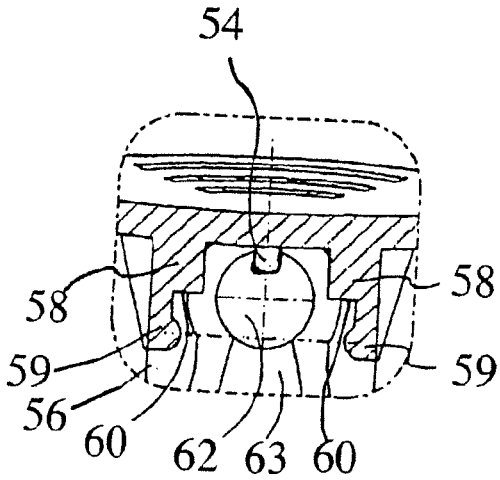

A preferred embodiment of the spray head according to the invention will now be described in more detail with reference to the drawings, wherein:

FIG. 1 shows a spray head according to the invention in sectional view from the side, FIG. 2 shows the holding element in perspective view from behind, FIG. 3 shows the holding element in section on the line III-III in FIG. 2, FIGS. 4*a* ,*b* show the holding element from diagonally above in perspective view and in section, FIG. 5 shows a cross-section through the holding element on the line V-V in FIG. 3, FIG. 6 shows a section through the spray head body in perspective view, FIG. 7 shows a section through the spray head body viewed from the side, FIG. 8 shows a section through the snap-fit projections in the spray head body along the line VIII-VIII in FIG. 7 and FIG. 9 shows a section through the spray head body along the line IX-IX in FIG. 7.

FIG. 1 shows a cross-section through the spray head according to the invention having a spray head body 10, a holding element 12 and a tubular duct element 14. The spray head body 10 comprises a fastening ring 16 with inwardly protruding projections 18 by means of which the fastening ring 16 can be attached to a spray container (not shown). The spray head body 10 further comprises an actuating element 20 with an actuating depression 22.

The holding element 12 has an inlet port 24, an adjoining tubular duct section 26 and a subsequent holding section 28. The holding section 28 is bent through 90° and is additionally supported by a wall 30. The holding element 12 also has an attachment 32 with a back wall 34 (cf. also FIGS. 2 to 5). The attachment 32 is open on its side 5 facing the actuating depression 22.

Inserted in the holding element 12 is a tubular duct element 14 in the form of a capillary tube. The capillary tube 14 serves to atomize the mixture of medium and propellant, and this mixture may also contain other ingredients. The capillary tube 14 is not necessarily made of the same plastics material as the holding element 12 and/or the spray head body 10 but may be made from a softer and more flexible material.

Further details of the holding element 12 can be found in FIGS. 2 to 5. FIG. 3 shows the holding element 12 with the tubular duct section 26. The tubular duct section 26 comprises in 15 the region of the inlet port 24 a section with a holding projection 36 for receiving a valve seat. Adjoining the holding projection 36 is a cylindrical holding section 38. Subsequently the diameter widens in a section 39 and is then limited by a holding section 40 which widens out in a conical shape on the side facing away from the inlet port 24. The tubular duct section 26 also has a receiving portion 42 for the capillary tube 14. 20 The capillary tube 14 abuts on the projection 36 in the inserted position.

The end of the tubular duct section 26 facing away from the inlet port 24 has a conical widening 46, adjacent to which is the attachment 32 with a back wall 34. The attachment 32 is roughly cuboid, cf. FIG. 4, while the back wall 34 is bounded by two side walls 35 to form a recess. In the inserted position the capillary tube 14 passes through the attachment 32.

The holding section 28 is bent through roughly 90° adjacent to the conical widening 46. As can be seen from FIG. 5, the holding section 28 is open on the side facing away from the bend, forming a recess for accommodating the tubular duct element 14 with a rounded base. At a spacing from one another in the holding section 28 are three clamping elements 50 in the form of projections extending in the longitudinal direction of the holding element 12, which hold the inserted capillary tube 14 in the holding section 28 by means of longitudinal ribs 51.

FIG. 6 is a perspective view of the spray head body 10 in the section shown in FIG. 1. The projection 52 which protrudes into the spray head body 10 and abuts on the back wall 34 is cut through its centre. The projection 52 is connected at the back to a wall 53 which protrudes from the spray head body 10 in the longitudinal direction of the holding section 28. FIG. 6 also shows a projection 54 on the outlet port, which like the wall 53 extends in the direction of the holding section 28 and is shown from in front in FIG. 8. Adjacent to the projection 52 is a second projection 55 which extends parallel to the first projection 52 but is shorter. The projection 52 has an end which is wedge-shaped in cross-section. In the assembled state the back wall 34 is located between the projections 52 and 55, thus holding the holding element 12 securely even during actuation.

FIG. 8 shows a detail in the region of the outlet port 62 with a slot 63. Snap-fit lugs 56 delimit a partly round opening. For connecting the holding element 12 to the spray head body 10 the holding element 12 is snapped in and held in the region of the holding section 28 close to the outlet port between the snap-fit lugs 56. The projection 54 (cf. see FIGS. 6 and 7) abuts on the tubular duct element 14 from above. The slot 63 on the one hand assists with the assembly of the holding element 12 and on the other hand, in the case of viscous media, allows any drops forming at the opening of the tubular duct element 14 to flow back and not to dry in the tubular duct element 14.

FIG. 7 shows a section through the spray head body 10. On the inside of the actuating depression 22 are provided two projections 58 at a spacing from one another, which have, on their facing sides, contact surfaces 60 in the form of a step. In the inserted position of the holding element 12 the projection 52 protrudes over the attachment 32 and lies flat against the back wall 34. The projection 58 has two latching elements 59, each having a contact surface 60, which abut on the side wall of the attachment 32.

In order to operate the spray head according to the invention force is applied to the actuating depression 22. This force is transmitted to the attachment 32 through the projection 58 and the contact surface 60 and presses the holding element 12 onto the valve. The latching elements 59 meanwhile hold the holding element laterally. The valve opens and the mixture of medium and propellant gas enters the capillary tube 14, where the medium to be delivered is atomized. The current exits through the outlet port 62 and the medium is sprayed. As soon as no more force is exerted on the actuating depression 22 the valve closes and the spray operation is at an end.

The invention claimed is:

1. Spray head for atomizing a medium using a pressurized propellant, comprising:

a spray head body having a fastening ring and an actuating element movably connected thereto, a holding element having an inlet port, an adjoining tubular duct section and a holding section, and a tubular duct element which has an outlet port for the medium and which has at least one section of a diameter causing the medium to be discharged to be atomized in the flow of propellant, the duct element being arranged in the holding section of the holding element, wherein the holding element comprises, at least one clamping element for clamping for latching onto an upper end of the tubular duct element;

wherein a lower end of said duct section has a holding section with a narrowing, the tubular duct element extending into held engagement with the narrowing of the holding section of tubular duct section, the tubular duct section and the tubular duct element inserted therein extending in a longitudinal direction of the spray head body wherein spray head body, holding element and tubular duct element are separate parts; and wherein the spray head body has a hollow inner space with a snap-in connector at an upper portion of the hollow inner space such that the holding element together with the duct element can be snapped into the spray head body within said hollow space, the holding element having a part for mating engagement with the snap-connector.

2. Spray head according to claim 1, wherein the tubular duct element is a capillary pipe or tube and has a constant inner diameter over its entire length.

3. Spray head according to claim 1, wherein the holding section of the holding element has an approximately 90° bend, and wherein the holding element is connected to the spray head body.

4. Spray head according to claim 1, wherein the at least one clamping element comprises at least one pair of clamping ribs which engage opposite sides of the tubular duct element.

5. Spray head according to claim 1, wherein the tubular duct element protrudes from the holding section at an upper end thereof.

6. Spray head according to claim 3, wherein the holding section comprises at least one opening on its side facing away from the bend.

7. Spray head according to claim 1, wherein the holding element has a receiving portion for a valve seat.

8. Spray head according to claim 7, wherein said holding section of the tubular duct has at least one cylindrical holding projection.

9. Spray head according to claim 8, wherein the at least one cylindrical holding projection comprises a first cylindrical holding projection adjacent to the receiving portion and a second cylindrical holding projection arranged at a distance from the first cylindrical holding projection.

10. Spray head according to claim 1, wherein the holding element has an attachment with a back wall that extends in the longitudinal direction of the spray head body.

11. Spray head according to claim 10, wherein the back wall has a recess on a side which faces away from the outlet port, the recess being laterally delimited by side walls extending in said longitudinal direction.

12. Spray head according to claim 11, wherein the spray head body has at least one projection which faces the holding element and abuts a flat on the back wall of the attachment and on the side walls of the recess.

13. Spray head according to claim 12, wherein the spray head body has a second projection that faces the holding element and abuts the back wall on a side that faces the outlet port.

14. Spray head according to claim 10, wherein the spray head body further comprises a contact surface which abuts on the attachment of the holding element.

15. Spray head according to claim 1, wherein the spray head body further comprises connecting means for the holding element.

16. Spray head according to claim 15, wherein the connecting means comprise two projections that face one another with protruding lugs which engage behind the holding element close to the outlet port of the tubular duct element.

17. Spray head according to claim 1, wherein the tubular duct element opens directly to the environment without restriction.

* * * * *